United States Patent [19]

Sundstrom

[11] Patent Number: 4,981,716

[45] Date of Patent: Jan. 1, 1991

[54] METHOD AND DEVICE FOR PROVIDING AN IMPACT RESISTANT SURFACE ON A METAL SUBSTRATE

[75] Inventor: Per Sundstrom, Jarfalla, Sweden

[73] Assignee: International Business Machines Corporation, Armonk, N.Y.

[21] Appl. No.: 346,845

[22] Filed: May 3, 1989

[30] Foreign Application Priority Data

May 6, 1988 [SE] Sweden ..... 8801733

[51] Int. Cl.[5] ..... B05D 3/06; B05B 7/00

[52] U.S. Cl. ..... 427/531; 427/27; 427/29; 427/33; 427/304; 427/305; 427/318; 427/319; 118/312; 118/602; 118/620

[58] Field of Search ..... 427/53.1, 304, 305, 427/318, 319, 29, 33, 27; 118/312, 602, 620

[56] References Cited

U.S. PATENT DOCUMENTS

| | | | |
|---|---|---|---|
| 2,933,414 | 4/1960 | Bech | 427/33 |
| 3,238,053 | 3/1966 | Morgan | 427/29 |
| 4,004,042 | 11/1977 | Fairbairn | 427/34 |
| 4,048,459 | 9/1977 | Earle | 219/85 |
| 4,117,302 | 9/1978 | Earle et al. | 219/121 |
| 4,125,926 | 11/1978 | Gale et al. | 29/156.5 |
| 4,200;669 | 4/1980 | Schaefer et al. | 427/53.1 |
| 4,212,900 | 7/1980 | Serlin | 427/383.9 |
| 4,218,494 | 9/1980 | Belmondo et al. | 427/35 |
| 4,281,030 | 7/1981 | Silfvast | 427/42 |
| 4,299,860 | 11/1981 | Schaefer et al. | 427/53.1 |
| 4,300,474 | 11/1981 | Livsey | 118/641 |
| 4,400,408 | 8/1983 | Asano et al. | 427/35 |
| 4,401,726 | 8/1983 | Gnanamuthu | 428/610 |
| 4,434,189 | 2/1984 | Zaplatynsky | 427/53 |
| 4,484,959 | 11/1984 | Boucher et al. | 148/127 |
| 4,520,754 | 6/1985 | George et al. | 427/33 |
| 4,537,793 | 8/1985 | Kehrer et al. | 427/35 |
| 4,612,208 | 9/1986 | Reichenecker | 427/53.1 |
| 4,627,896 | 12/1986 | Nazmy et al. | 204/37.1 |
| 4,644,127 | 2/1987 | La Rocca | 219/121 |

FOREIGN PATENT DOCUMENTS

| | | |
|---|---|---|
| 60-92461 | 5/1985 | Japan . |
| 0221752 | 10/1986 | Japan . |
| 8500483 | 2/1985 | Sweden . |
| 8501910 | 2/1985 | Sweden . |
| 1587235 | 8/1977 | United Kingdom . |

OTHER PUBLICATIONS

Teknisk Rapport "Ytimpregnering Med Laser".

"Modificatioin of Metal Surfaces by the Laser Melt-Particle Injection Process" by Ayers, published in Thin Film Solids, vol. 84, 1981, pp. 323-331.

"A Laser Processing Technique for Improving the Wear Resistance of Metals" by Ayers et al, published by Journal of Metals, Aug. 1981.

*Primary Examiner*—Stanley Silverman

*Attorney, Agent, or Firm*—Judith D. Olsen

[57] ABSTRACT

A method for providing a metal substrate with an impact resistant surface is disclosed. The surface of the substrate is exposed to high intensity laser radiation to melt a spot of the surface. Particles of a material such as WC are injected into the melt.

In order to enhance the percentage of particles in the surface, thus increasing the wear resistance, there is a forced reflection of stray particles back toward the melted spot.

Further a fixture for holding the substrate, comprising the essential reflection surfaces for achieving the desired back reflection is described as well as a device for carrying out the method.

27 Claims, 4 Drawing Sheets

METHOD AND DEVICE FOR PROVIDING AN IMPACT RESISTANT SURFACE ON A METAL SUBSTRATE

Figure 1:
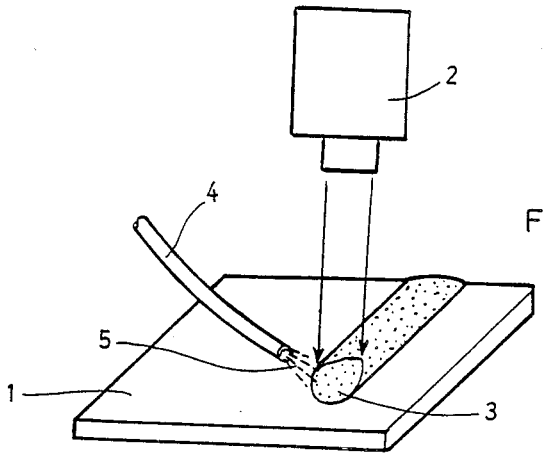

The present invention relates to a method and a device for providing an impact resistant surface on a metal substrate, in particular the impact portion of a print hammer for a dot matrix impact printer.

It also relates to a fixture for holding a substrate and for making possible the process according to the invention.

Surface hardening is a common process in any industrial manufacturing activity where wear of component parts of the manufactured product occurs, and there are numerous different methods for hardening of all kinds of surfaces known, many methods of which are patented.

Fairly recently the use of lasers of high intensity has become more and more common for hardening purposes when using heat as a means for hardening. The reason for this is that the energy of the laser beam is very concentrated, thereby offering the possibility to harden local spots on the work piece without undesired energy dissipation. It is not possible though to create surfaces of a sufficient hardness for all applications only by means of simple heating.

Traditionally one has used coatings of various kinds, e.g. chromium, to achieve this desired hardness. Coating with chromium is however a very undesirable process, since it is a wet chemical process with accompanying environmental and waste disposal problems.

As indicated above there is an abundance of patents relating to this technology, DE-1 521 372, FR-2 575 185, GB-1 587 235, US-4 004 042, US-4,218,494,US-4 281 030, US-4 299 860, US-4 300 474, US-4 434 189,and US-4 644 127, being the most relevant as prior art for the present invention. In fact, the present invention is a development and improvement of the invention disclosed in US-4 299 860. The subject matter of said patent is further discussed from a more scientific viewpoint in an article in "Journal of Metals", August 1981, pp. 19–23.

An evaluation of the method was carried out by a group at "Hogskolan i Lulea" (the Technical High-School in Lulea, Sweden) and published in "Teknisk Rapport" (Technical Report) 1986:11 T, STU-projekt 82-4237, 83-3959, 84-4277.

In the above mentioned patent a method for hardening by impregnating the surface of a metal substrate with wear resistant particles is disclosed. The substrate surface is subjected to a relatively moving high-power laser beam to cause localized surface melting in passes thereacross, and hard wear resistant particles are forcibly velocity injected into the melt. The particles are captured upon solidification of the melt pool and retained therein by metallurgical bond.

It is desirable to achieve approximately 50% powder admixed to the substrate surface, in order to make it sufficiently hard.

Experiments in order to try and reproduce the results claimed in said patent, have shown that it is very difficult to produce surfaces with sufficiently high particle content.

In US-4 299 860 it is stated that the process preferably is carried out in a vacuum chamber, which of course is a major drawback when the method is to be implemented for industrial use.

It is therefore an object of the present invention to improve the previously known method in order that high powder percentages are easily achieved, and so that it can be carried out at ambient pressure with the same good result.

It is another object of the invention to propose a device with which the improved method is carried out, and particularly to a fixture for holding the substrate properly in the device in order that the method of the invention be possible to carry out.

These objects are achieved with the method and device according to the invention, as disclosed in the attached patent claims.

Figure 2:
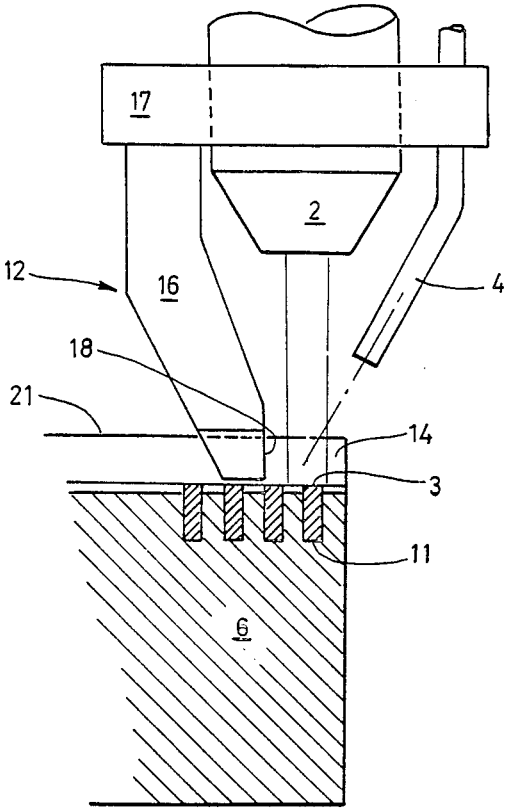
Figure 3A:
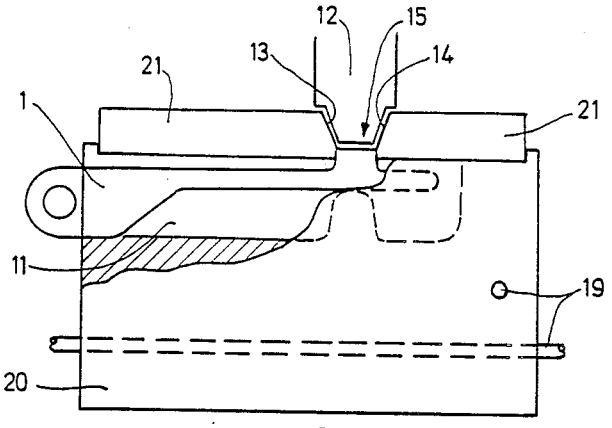
Figure 3B:
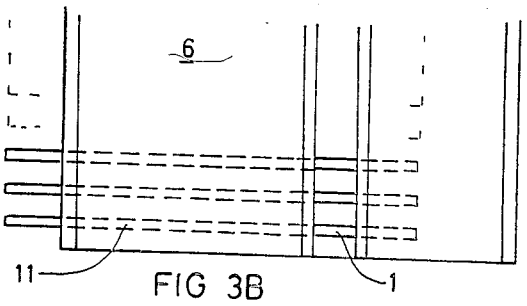
Figure 4:
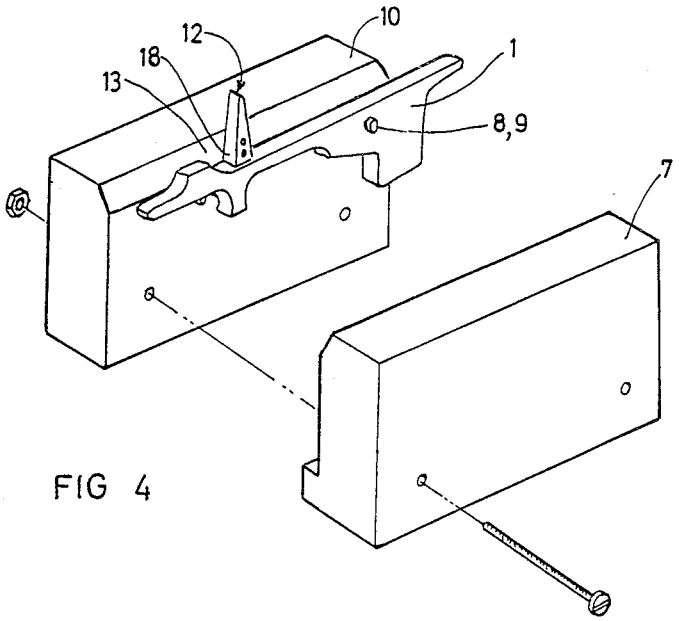
Figure 5:
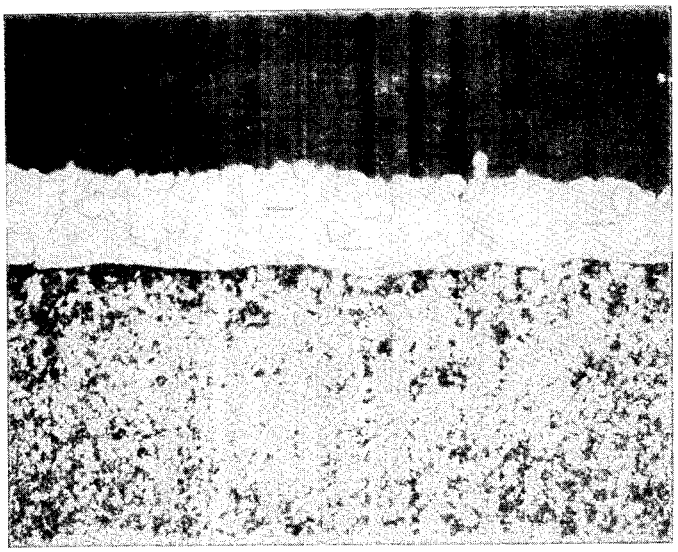
Figure 6:
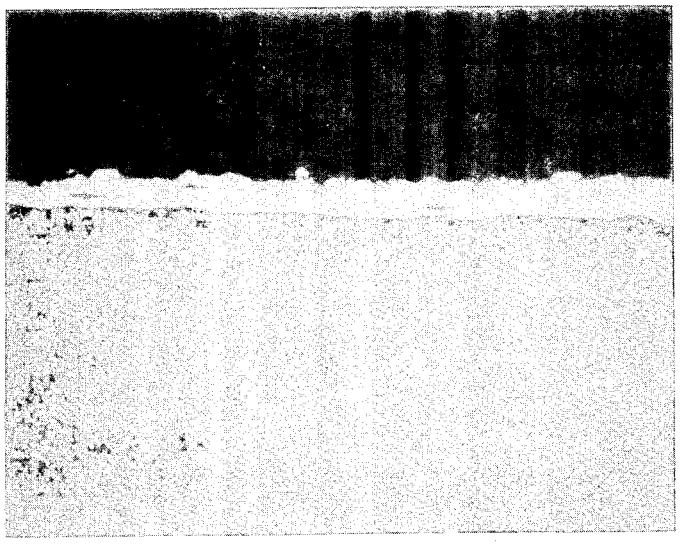
Figure 7:
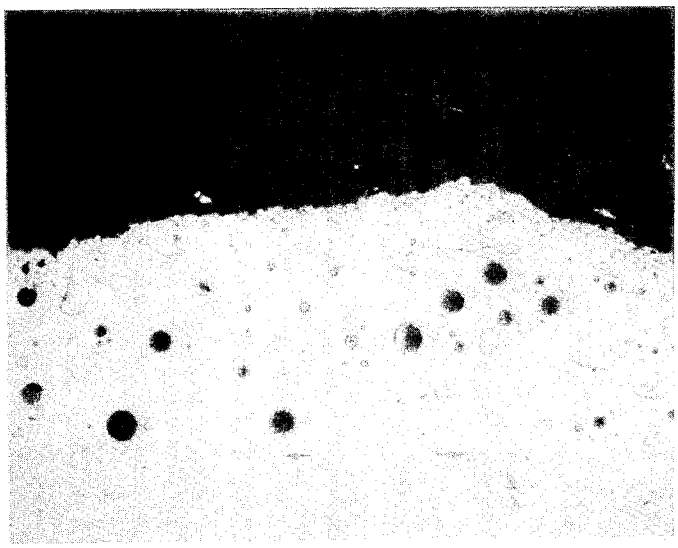
Figure 8:
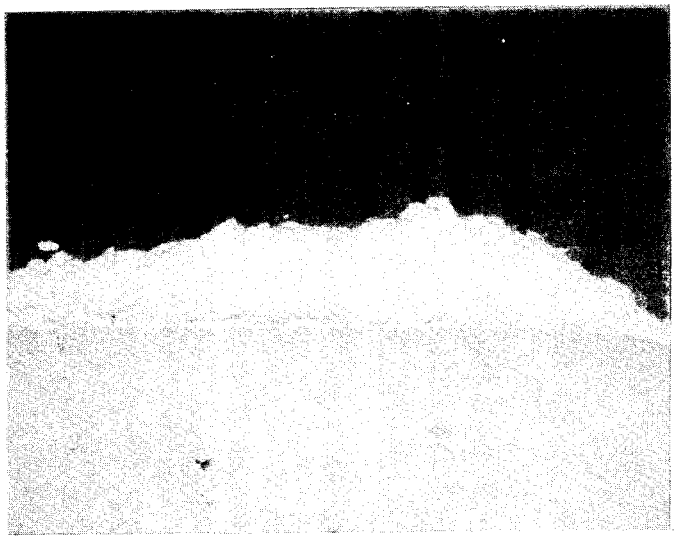

A detailed description of the invention will be given below with reference to the drawings, where like reference numerals denote the same or equivalent parts, and in which:

FIG. 1 shows the principle of operation of the method according to US-4 299 860, FIG. 2 is schematic view of the setup for carrying out the method according to the invention, FIG. 3 A and B shows a preferred embodiment of a fixture according to the invention, for holding several objects to be treated, FIG. 4 shows an alternative embodiment of the fixture, FIG. 5 is a microphotograph of a polished cross section of a sample (no 1), FIG. 6 is a cross section of another sample (no 2), FIG. 7 is a cross section of a further sample (no 13), and FIG. 8 is a cross section of a non-primary target area of still another sample (no 7).

In FIG. 1 is shown the principle of the method according to US-4 299 860 (corresponding to FIG. 1 in said patent.

Thus, a substrate 1 (e.g. a print hammer) is moved horizontally while being irradiated by a high-intensity laser 2. The energy of the laser beam causes the substrate surface to melt 3 locally A particle injection device 4, is arranged to provide a controlled stream of particles 5 directed toward the molten spot 3 on the substrate surface. The particles are carried by an inert gas, e.g. helium or argon.

A series of experiments were performed using an experimental setup corresponding to the described one, and with experimental parameters according to Table I. Microphotographs of a few samples from these experiments shown in FIG. 5–8.

TABLE I

| SAMPLE | FEED (m/min) | LASER POWER | POWDER | MATERIAL |
|---|---|---|---|---|
| 1 | 0.35 | 2.3 kW | 10112 | Boloc 2 |
| 2 | 0.35 | 1.9 | 10112 | Boloc 2 |
| 3 | 0.25 | 1.9 | reject | Boloc 2 |
| 4 | 0.35 | 2.2 | reject | Boloc 2 |
| 5 | 0.40 | 2.3 | reject | Boloc 2 |
| 6 | 0.35 | 2.3 | reject | Boloc 2 |
| 7 | 0.35 | 2.3 | 10112 | Ham 8260 |
| . | ... | ... | ... | ... |
| . | ... | ... | ... | ... |
| . | ... | ... | ... | ... |
| 13 | 0.34 | 2.3 | 10900 | Ham 8260 |
| 14 | 0.36 | 2.3 | 10900 | Ham 8260 |
| . | ... | ... | ... | ... |
| . | ... | ... | ... | ... |
| . | ... | ... | ... | ... |

The results are not very encouraging. First of all the percentage of imbedded powder particles is not high enough (FIG. 5–6), and secondly the occurrence of bubbles in the melt often creates an abundance of cavities (FIG. 7) in the surface layer. However, in one experiment (FIG. 8; sample 7) one clearly sees a very high concentration of particles in the surface layer.

It seems as if this surprising result can be related to one specific condition, namely that the substrate surface shown, which was not the primary target, was held slightly lowered (11 mm in this particular case) from the surrounding surfaces, i.e. the substrate was located in a kind of cavity with walls surrounding it.

It is believed that the walls of this cavity act as a kind of reflector, directing particles that deflect from the particle stream back toward the substrate surface, thereby increasing the particle concentration.

The obvious way of achieving higher concentration would otherwise, of course, be to try to increase the flow rate in the injection device, but it turns out that such a measure only disturbs the process and results in inhomogeneous and irregular surfaces.

With reference to FIGS. 2–4, the method according to the invention and the device according to the invention including the two embodiments of the fixture will now be described in detail.

The setup or device for carrying out the invention comprises a CO2 laser with an output of 2,500 W.

The particle injection device 4 can be of any commercially available type that meet the specific requirements, namely of maintaining a steady flow with no fluctuations. It should also be adjustable with regard to the ratio gasflow/particle content. The preferred angle of particle impingement is 55–65 degrees, most preferably 60 degrees.

The rate of particle supply by the injection device is 10–12 g/min, preferably 11.4 g/min (0.19 g/s).

The feeding system (not shown) for the substrate, i.e. the mechanism for imposing the relative motion of the substrate must be extremely steady in order that the distribution of particles in the melt be homogeneous. This is however a matter of constructive engineering pertaining to the field of one skilled in the art, and will not be discussed here.

The essential part of the device for carrying out the invention is the fixture 6 for securely holding the substrate 1 in a correct relative position with respect to the laser beam 2 and the particle stream 5.

In FIG. 4 a simple, single substrate embodiment of the fixture according to the invention is shown. It comprises a first block 7 of copper with a guide pin 8 which is adapted to be received in a corresponding hole 9 in the object 1 which is to be treated (in the present example a print hammer for an impact printer). The use of copper is preferred because of its very good heat conductivity which diminishes the cooling problem. Still it might be necessary to water cool the system for optimum results. The cooling could be achieved by feeding water through channels 19 in the fixture.

The fixture also comprises a second copper block 10, and the object to be treated is placed between the two blocks and secured by suitable means such as a screw and nut, a clamp or the like.

The fixture could also in a preferred embodiment (FIG. 3A and B) comprise one single block 20 provided with a plurality of transverse recesses 11 in which the objects to be treated are placed. This fixture is adapted for mass production.

The object is placed between the blocks 7, 10 (or in a recess 11) with the surface that is to be processed below the level of the upper surfaces of the fixture blocks. Thereby the device and substrate together form a kind of cavity 15.

In the preferred embodiment there is provided a retaining means 21 to be placed on top of the block 6. In order that the substrate be surrounded by walls on at least three sides there is provided reflection means 12 which together with the side walls 13, 14 (forming part of the retaining means 21 in the preferred embodiment), of the first and second blocks respectively, form the desired cavity structure This reflection means can also be made of copper, and in the shown preferred embodiment it is comprised of an arm 16 extending from the chassis 17 or framework of the entire apparatus, and down into the cavity 15 formed by the two blocks.

In the shown embodiments the reflection means has its reflection surface 18 oriented vertically, but it could be provided with means for adjusting at different angles with respect to the surface of the object substrate, and it can also be adjustable lengthwise in the cavity. The reflection means 12, 18 can of course have any other suitable shape, as long as the desired reflection is achieved, and it is considered a matter of ordinary engineering skill to design it properly.

The side walls 13, 14 of the cavity 15, i.e. the inner walls of the first and second copper blocks 7, 10, are bevelled at an angle of approximately 12–17 degrees, in the described and preferred embodiment 15 degrees, with respect to a vertical plane.

It is also conceivable to arrange for the side walls to be adjustable as to their inclination instead of bevelling them. Adjusting the inclination is also only a practical measure and do not form part of the invention per se.

Thus, there are several possibilities for varying the conditions of the process in order to optimize it, a couple of which relate to the position of the substrate in the fixture, and to the relative position of the reflection means.

When carrying out the method, a substrate 1 to be treated (or a plurality of substrates) is placed in the fixture 6 and the retaining means 21 is placed on top. This aggregate 1, 6, 21 is brought in relative motion with respect to the laser 2 and the particle injection device 4. The laser is activated in order to liquefy the desired portion 3 of the substrate. The laser could be continuous or pulsed. During this action, a stream of particles is directed toward the surface spot 3 that is to be treated. Particles could be supplied in batches or continuously.

During particle supply, stray particles deflecting from the main path are reflected back by means of the reflection surfaces 13, 14 on the retaining means 21, and by means of the reflection means 12, 18, thereby improving the particle content in the treated surface spot.

The optimal results have been achieved with the reflection surface 18 oriented vertically, and with the reflection surfaces 13, 14 oriented at an angle of 15 degrees with respect to a vertical plane.

Now an example of the method according to the invention will be described.

In Table I is listed a series of experimental parameters for a number of samples. As already mentioned, sample 7 exhibited a very good surface on a portion that was not the primary target for the process.

Since the result of that particular sample was so good, the conditions of this experiment is used as an example of how to successfully carry out the invention.

Thus, a powder obtainable from Castolin, Inc., comprising 0.5% C, 3% Cr, 1% Fe, 35% Ni, and WC for the rest, and with a particle size of 0.05–0.10 mm was used.

The substrate (a print hammer in this case) was made of a material labelled AISI 8620 or IBM 07-740, containing <0.18–0.23% C, 0.2–0.35% Si, 0.7–0.9% Mn, <0.035% P, <0.04% S, 0.4–0.6% Cr, 0.4–0.7% Ni, 0.15–0.25% Mo, and Fe for the rest.

The print hammer was coated with Cu before being subject to treatment according to the invention.

The surface to be treated was placed in the above described fixture, in such a way that the surface was 11 mm below the surrounding surfaces of the fixture.

The reflection surfaces were given an inclination of 15 degrees with respect to a vertical plane through the substrate, and the substrate was moved horizontally at a speed of 350 mm/min.

The laser was run at an output of 2.3 kW, and the powder feed was 5% (this is a measure of the volume ratio powder/carrier gas, and is a manufacturer specific measure for the particular device used), corresponding to 11.4 g/min (0.19 g/s).

The result of a run with the above parameters is shown in FIG. 7. This is a section of the sample that has been polished and photographed under a microscope, and the content of WC-particles is estimated to >50%, which is a fully satisfactory result.

The hardness is measured with the Knoop method and the measurements were performed at different portions of the section, corresponding to different depths in the sample.

The results were as follows (hardness in Knoop 0.5 kg)

| | |
|---|---|
| Matrix between particles | 384 |
| WC particles | 2044 |
| Intermediate zone between surface and bulk | 486 |
| At a depth of 0.05 mm | 390 |
| At a depth of 0.1 mm | 358 |
| At a depth of 0.15 mm | 296 |

An impact test corresponding to two customer years was carried out and no significant changes in the surface could be detected.

Thus, in this application there is disclosed a device and a method for providing an impact resistant surface on a metal substrate, with excellent properties, unattainable with previous techniques.

It is apparent for the person skilled in the art that the given disclosure only is exemplifying, and that the invention can be varied significantly within the scope of the appended claims.

I claim:

1. A method of providing an impact resistant surface on a metal substrate comprising:
   mounting the substrate in a movable fixture;
   liquefying a surface portion of the substrate by means of high intensity laser radiation;
   injecting into the liquid surface portion particles of a material having a substantially greater wear resistance than that of the metal substrate, the substrate metal thus forming a matrix for the particles;
   forcing stray particles, that deflect from the particle beam and thus doe not impinge on the molten substrate portion, to reflect back toward and into the surface of the substrate; allowing the liquid metal to solidify thereby trapping the injected particles in the in the matrix of the metal substrate; and
   moving the fixture relative to the laser radiation and the injecting particles, whereby the process is continued along the substrate surface to a predetermined completion point.

2. The method according to claim 1, further comprising:
   coating the metal substrate with copper prior to liquefying a surface portion of the substrate.

3. The method according to claim 1 or 2, characterized in that the forced reflection of particles occurs against a first vertical reflection surface, and at least one further surface forming an angle of 12–17 degrees, preferably 15 degrees with respect to a vertical plane.

4. The method according to claim 1, characterized in that the angle of particle supply is 55–65 degrees, relative a horizontal plane.

5. The method according to claim 1, characterized in that the angle of particle supply is 60 degrees relative to a horizontal plane.

6. The method according to claim 1, characterized in that the sample velocity past the laser beam is 0.3–0.4 m/s.

7. The method according to claim 1, characterized in that the sample velocity past the laser beam is 0.35 m/s.

8. The method according to claim 1, characterized in that the rate of particle supply is 10–12 g/min.

9. The method according to claim 1, characterized in that the rate of particle supply is 11.4 g/min.

10. The method according to claim 1, characterized in that the particle size is 0.02–0.15 mm.

11. The method according to claim 1, characterized in that the particle size is 0.05–0.10 mm.

12. A fixture for holding a sample to be provided with an impact resistance surface, said fixture comprising:
   means for mounting a substrate movably with respect to a laser beam and a particle stream;
   retaining means, situated atop the mounting means; and
   reflection surfaces within the retaining means for reflecting stray particles of a particle stream back toward the sample surface.

13. The fixture according to claim 12, further comprising means for adjusting the positions of said reflection surfaces relative the substrate.

14. The fixture according to claim 12 or 13, wherein one reflection surface is vertical and the angle of the other reflection surfaces is 12–17 degrees with respect to a vertical plane.

15. The fixture according to claim 12 or 13, wherein one reflection surface is vertical and the angle of the other reflection surfaces is 15 degrees with respect to a vertical plane.

16. The fixture according to claim 12, wherein the fixture comprises a material having a very high thermal conductivity.

17. The fixture according to claim 16, wherein the material is copper.

18. The fixture according to claim 12, further comprising means for cooling the fixture.

19. The fixture according to claim 18, wherein the cooling means comprises channels in the fixture for carrying water or other suitable cooling media.

20. A device for providing an impact resistant surface on a metal substrate, comprising:
   a high intensity laser;

particle distribution means for directing a stream of particles toward the substrate; and a fixture for holding the metal substrate movably relative to the laser and particle distribution means, said fixture having a retaining mean which includes reflection surfaces for reflecting stray particles of the particle stream back toward the surface of the metal substrate.

21. The fixture according to claim 20, further comprising means for adjusting the positions of said reflection surfaces relative to the substrate.

22. The fixture according to claim 20 or 21, wherein one reflection surface is vertical and the angle of the other reflection surfaces is 12–17 degrees with respect to a vertical plane.

23. The device according to claim 20 or 21, wherein one reflection surface is vertical and the angle of the other reflection surfaces is 15 degrees with respect to a vertical plane.

24. The device according to claim 20, wherein the fixture comprises a material having a very high thermal conductivity.

25. The device according to claim 24, wherein the material is copper.

26. The device according to claim 20, further comprising means for cooling the fixture.

27. The device according to claim 26, wherein the cooling means comprises channels in the fixture for carrying water or other suitable cooling media.

* * * * *